US010296026B2

(12) United States Patent
Caffee et al.

(10) Patent No.: US 10,296,026 B2
(45) Date of Patent: May 21, 2019

(54) LOW NOISE REFERENCE VOLTAGE GENERATOR AND LOAD REGULATOR

(71) Applicant: Silicon Laboratories Inc., Austin, TX (US)

(72) Inventors: Aaron J. Caffee, Scappoose, OR (US); Vaibhav Karkare, San Jose, CA (US)

(73) Assignee: Silicon Laboratories Inc., Austin, TX (US)

( * ) Notice: Subject to any disclaimer, the term of this patent is extended or adjusted under 35 U.S.C. 154(b) by 558 days.

(21) Appl. No.: 14/918,651

(22) Filed: Oct. 21, 2015

(65) Prior Publication Data

US 2017/0115677 A1 Apr. 27, 2017

(51) Int. Cl.

| | |
|---|---|
| ***H03K 5/003*** | (2006.01) |
| ***G05F 1/567*** | (2006.01) |
| ***G05F 3/20*** | (2006.01) |
| ***G05F 3/30*** | (2006.01) |
| ***H01L 35/00*** | (2006.01) |
| ***G05F 1/46*** | (2006.01) |
| ***G05F 1/575*** | (2006.01) |

(52) U.S. Cl.
CPC ..... *G05F 1/468* (2013.01); *G05F 1/575* (2013.01)

(58) Field of Classification Search
CPC ... G05F 1/575; G05F 3/26; G05F 3/30; G05F 1/10; G05F 3/02; G05F 3/16; G05F 3/20; G01K 1/00; H01L 35/00
USPC ..... 327/530–546; 323/312–317
See application file for complete search history.

(56) References Cited

U.S. PATENT DOCUMENTS

| | | | | |
|---|---|---|---|---|
| 4,800,339 | A * | 1/1989 | Tanimoto | H03F 3/3001 330/253 |
| 6,191,637 | B1 * | 2/2001 | Lewicki | G05F 3/245 323/316 |
| 6,218,900 | B1 * | 4/2001 | Nolan | H03F 1/52 327/52 |
| 6,628,558 | B2 * | 9/2003 | Fiscus | G11C 5/147 327/512 |
| 7,224,210 | B2 | 5/2007 | Garlapati et al. | |
| 7,321,225 | B2 | 1/2008 | Garlapati et al. | |
| 7,579,899 | B2 * | 8/2009 | Senriuchi | G01D 3/036 327/512 |
| 8,816,670 | B2 * | 8/2014 | Lee | H03F 3/45928 323/312 |
| 9,864,389 | B1 * | 1/2018 | Vijaykumar | G05F 1/575 |
| 2010/0225384 | A1 * | 9/2010 | Hirose | G05F 3/242 327/543 |
| 2011/0169561 | A1 * | 7/2011 | Chu | G05F 3/30 327/539 |

(Continued)

*Primary Examiner* — Brandon S Cole
(74) *Attorney, Agent, or Firm* — Zagorin Cave LLP

(57) ABSTRACT

A low-noise voltage reference generator that utilizes internal gain and feedback to generate an output signal having reduced sensitivity to power supply variations and loading conditions is described. A method includes generating a current based on a voltage drop across a resistor. The voltage drop is based on a second voltage drop across a gate terminal of a transistor and a source terminal of the transistor. The method includes the current using a reference voltage to generate a mirrored current through a node coupled to the drain terminal of the transistor. The method includes generating a level-shifted voltage using a voltage on the node. The method includes buffering the level-shifted voltage using a power supply voltage to generate the reference voltage.

21 Claims, 5 Drawing Sheets

(56) References Cited

U.S. PATENT DOCUMENTS

| | | | | |
|---|---|---|---|---|
| 2013/0249527 | A1* | 9/2013 | Arnold | G05F 3/30 323/314 |
| 2015/0091537 | A1 | 4/2015 | Caffee et al. | |
| 2016/0334470 | A1* | 11/2016 | Sandhu | G01R 19/16552 |

* cited by examiner

LOW NOISE REFERENCE VOLTAGE GENERATOR AND LOAD REGULATOR

BACKGROUND

Field of the Invention

The present invention relates to integrated circuits and more particularly generating a reference signal in integrated circuits.

Description of the Related Art

In general, a bandgap reference circuit provides a voltage reference with improved temperature stability and is less dependent on power supply voltage than other known voltage reference circuits. Bandgap reference circuits typically generate a reference voltage approximately equal to the bandgap voltage of silicon extrapolated to zero degrees Kelvin, i.e., $V_{G0}$=1.205V. To achieve a target reference voltage, these circuits typically use voltage multiplication, which increases output noise. Typical voltage reference circuits include a current mirror coupled to the power supply and the voltage reference node to provide a current proportional to absolute temperature (i.e., PTAT) to the voltage reference node. These circuits can be made with relatively low cost, but have the disadvantages of having high noise for a particular power consumption and being sensitive to power supply noise, which reduces the accuracy of the voltage reference. Accordingly, improved techniques for generating reference voltages are desired.

SUMMARY OF EMBODIMENTS OF THE INVENTION

A low-noise voltage reference generator that utilizes internal gain and feedback to generate an output signal having reduced sensitivity to power supply variations and loading conditions is described. In at least one embodiment of the invention, a method includes generating a current based on a voltage drop across a resistor. The voltage drop is based on a second voltage drop across a gate terminal of a transistor and a source terminal of the transistor. The method includes the current using a reference voltage to generate a mirrored current through a node coupled to the drain terminal of the transistor. The method includes generating a level-shifted voltage using a voltage on the node. The method includes buffering the level-shifted voltage using a power supply voltage to generate the reference voltage.

In at least one embodiment of the invention, an apparatus includes a buffer amplifier configured to transfer a signal from an input node to an output reference node using a power supply voltage on a first power supply node. The apparatus includes a current mirror coupled to the output reference node and configured to generate a mirrored current through a first node based on a first current through a second node and a voltage on the output reference node. The apparatus includes a resistor coupled between the second node and a second power supply node. The apparatus includes a first transistor of a first type having a gate terminal coupled to the first node and a source terminal coupled to the second node. The first transistor is configured to develop a voltage drop across terminals of the resistor to generate the first current. The apparatus includes a level-shifting circuit configured to level shift a voltage on the first node to drive the input node of the buffer amplifier.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DETAILED DESCRIPTION

Figure 1:
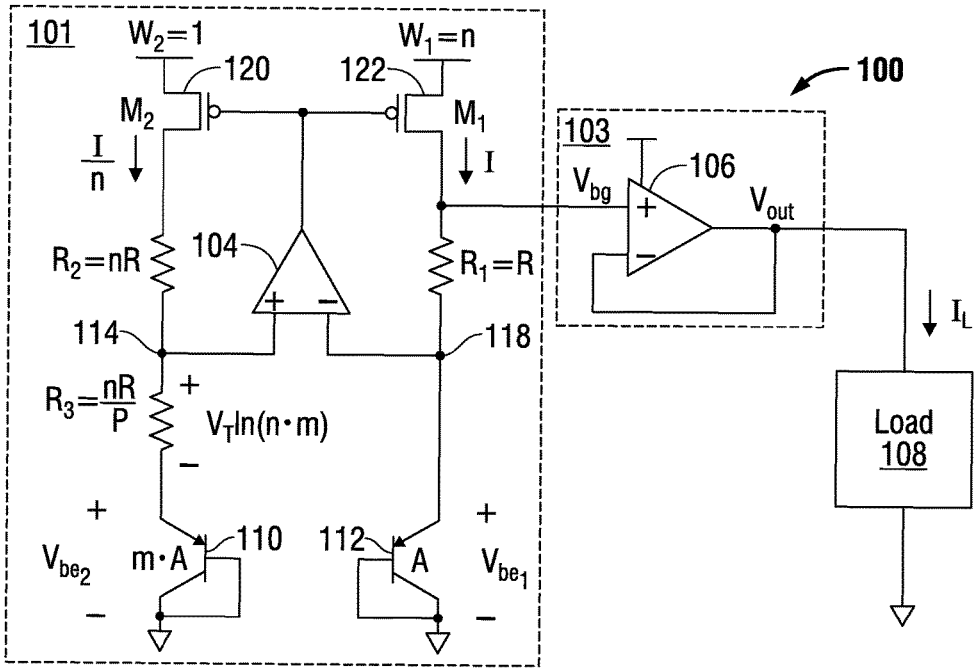
FIG. 1 (PRIOR ART)
FIG. 1 illustrates a circuit diagram of an exemplary bandgap voltage reference generator circuit.

Referring to FIG. 1, a typical low-noise, on-chip regulated voltage reference is implemented in two stages. Voltage reference generator 101 establishes a voltage that is relatively independent of the external supply (i.e. has sufficient power supply rejection for a target application) and has relatively low noise. Voltage reference generator 101 provides the low-noise and supply insensitive reference to buffer circuit 103, which provides adequate current for a variety of loading conditions. Voltage reference generator 101 is a typical bandgap voltage reference that utilizes temperature behavior of diodes to generate a voltage having a negative temperature coefficient (i.e., a negative first-order temperature coefficient) and a voltage having a positive temperature coefficient (i.e., a positive first-order temperature coefficient) and combines those voltages to produce an approximately zero temperature coefficient reference voltage. Voltage reference generator 101 takes advantage of two electrical characteristics to achieve the desired reference voltage $V_{bg}$: the base-emitter voltage $V_{BE}$, of a bipolar transistor is nearly complementary to absolute temperature T, e.g., $V_{BE}$=(−1.5 mV/° K×T+1.22)V, and thermal voltage $V_T$ is proportional to absolute temperature T, i.e, $V_T$=kT/q, where k is the Boltzmann constant and q is the magnitude of the electrical charge on the electron. Although pure diodes are preferable because they generate a higher diode drop for the same current, the typical bandgap voltage reference manufactured in a complementary metal-oxide-semiconductor (CMOS) process uses diode-coupled, bipolar junction transistors (i.e., BJTs or bipolar transistors), which are readily available in a CMOS process (e.g., pnp bipolar transistors formed from p-type diffusion, an n-type well, and a p-type well in the CMOS process). The voltage across the diodes (or diode-coupled bipolar junction transistors) has a negative temperature coefficient, but the voltage difference between two diode drops in which the current densities differ is proportional to absolute temperature (PTAT). The use of two banks of bipolar junction transistors of different sizes (or two identical banks with different currents) can generate voltage difference $\Delta V_{BE}$. The typical bandgap forces voltage difference $\Delta V_{BE}$ across a relatively temperature insensitive resistor (e.g., a polysilicon resistor) using negative feedback, which generates a PTAT current through the resistor. Another resistor is placed in series, which amplifies voltage difference $\Delta V_{BE}$ to cancel the negative temperature coefficient of the diode drop.

For example, reference voltage $V_{bg}$ is stable with respect to temperature variations. A voltage proportional to absolute temperature (i.e., a PTAT voltage) may be obtained by taking the difference between two base-emitter voltages of transistors biased at different current densities:

$$\Delta V_{BE} = V_T \ln\left(\frac{J_1}{J_2}\right),$$

where $J_1$ and $J_2$ are the current densities of corresponding bipolar transistors. Accordingly, voltage reference circuit 101 includes a pair of pnp bipolar transistors (i.e., transistors 110 and 112) that are coupled in a diode configuration (i.e., the collectors and bases of these transistors are coupled together) and coupled to ground. Transistor 110 has area A that is m times larger than the area of transistor 112. In addition, the current mirror including transistors 120 and 122 and that is used to bias transistors 110 and 112 has a current ratio of n. Thus, the current density ratio of transistor 110 and transistor 112 varies by a factor of n×m. The emitter of transistor 112 is coupled to an inverting input of operational amplifier 104. The emitter of transistor 110 is coupled, via resistor $R_3$, to the non-inverting input of operational amplifier 104. Operational amplifier 104 maintains equivalent voltages at nodes 114 and 118, i.e., $V_{118}=V_{114}=V_{BE112}$. Hence, the difference between $V_{BE112}$ and $V_{BE110}$ (i.e., $\Delta V_{BE112,110}$) forms across resistor $R_3$. Operational amplifier 104 and transistors 120 and 122 convert this voltage difference into a current (i.e., current I) proportional to the voltage difference, which is proportional to the thermal voltage $V_T$:

$$I = \frac{n\Delta V_{BE112,110}}{R_3} = \frac{pV_T \ln(nm)}{R_1}$$

Since the thermal voltage $V_T$ is proportional to absolute temperature via the constant factor k/q, $k=1.38\times10^{-23}$ J/K and $q=1.6*10^{-19}$ C, the current proportional to the voltage difference is also proportional to an absolute temperature, i.e., I is a PTAT current.

Transistor 110 provides a voltage nearly complementary to absolute temperature (i.e., a CTAT voltage) because the base-to-emitter voltage $V_{BE}$ of a bipolar transistor is nearly complementary to absolute temperature. By compensating the PTAT current with a CTAT voltage, transistors 120, 122, 110, and 112, and resistors $R_1$, $R_2$, and $R_3$, may be appropriately sized to generate a particular reference voltage output having an approximately zero temperature coefficient:

$$V_{bg}=V_{BE110}+(1+p)V_T \ln(nm).$$

If n, m, and p are selected to generate $V_{bg}$ with zero temperature coefficient at 300° K, then $$V_{bg}=0.74V+0.45V=1.19V\approx1.2V.$$

$V_{bg}$ is approximately equal to the bandgap voltage of silicon extrapolated to zero degrees Kelvin $V_{G0}=1.205V$.

Adding a PTAT voltage to a diode drop produces an approximately zero temperature coefficient point at approximately 1.2 V, resulting in a circuit that is not substantially sensitive to the effects of process variation on the bipolar junction transistor. The ratiometric manner in which the resistors are used also reduces effects of process variation, aging, and strain sensitivity. In an exemplary embodiment of the voltage reference, the ratio of $R_2$ to $R_3$ (i.e., the value p) is approximately 5 to 10 (i.e., $p=R_2/R_3\approx5\text{-}10$). Operational amplifier 104 compares voltage difference $\Delta V_{BE}$ (e.g., a voltage less than 100 mV) along with input-referred noise of operational amplifier 104 and thus substantially degrades the signal-to-noise ratio of reference voltage $V_{bg}$. To effectively reduce the noise, a higher power operational amplifier may be used to gain the input signal to obtain a target reference voltage level over temperature. Operational amplifier 104 has a feedback factor that causes a reduction in loop gain and bandwidth from the open loop gain. Buffer circuit 103 is series-coupled in the signal path for load regulation and is coupled to the power supply, which introduces power supply noise into the output signal $V_{OUT}$.

Figure 2:
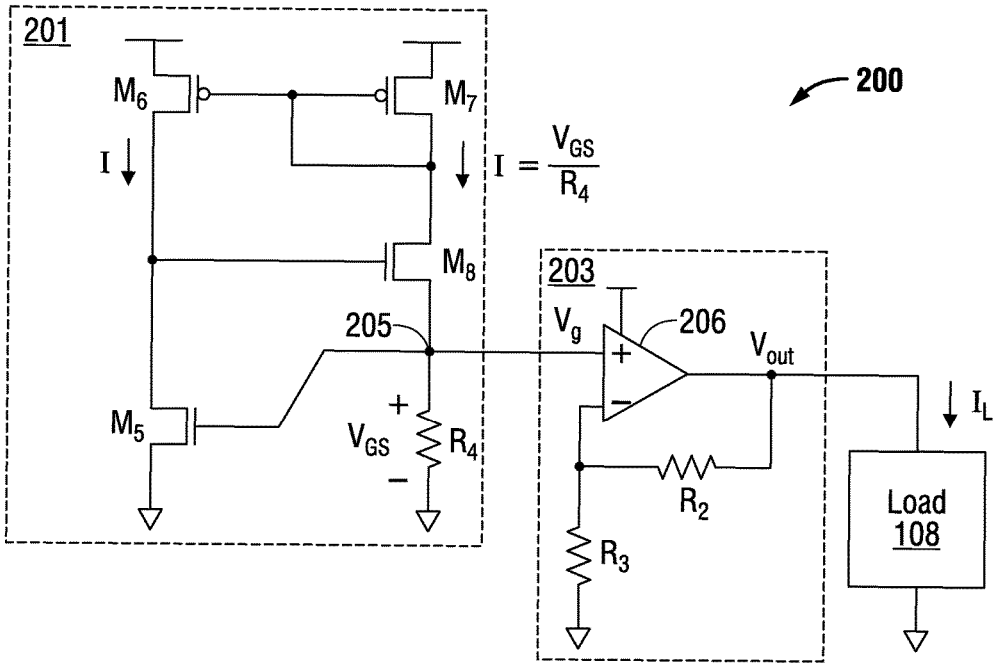
FIG. 2 (PRIOR ART)
FIG. 2 illustrates a circuit diagram of an exemplary $V_{GS}$/R voltage reference generator circuit.

A technique for reducing effects of noise on the output of a voltage reference generator as compared to noise sensitivity of the output of voltage reference generator 100 includes using a $V_{GS}$/R topology. Referring to FIG. 2, voltage reference generator 200 uses the zero temperature coefficient point of transistor $M_5$, i.e., the point where a constant current causes no change in the gate-to-source voltage $V_{GS}$ of transistor $M_5$ due to cancellation of the negative temperature coefficient of the threshold voltage of transistor $M_5$ with the positive temperature coefficient of overdrive voltage $V_{DSAT}$ of transistor $M_5$. If transistor $M_5$ is in the saturation region of operation, the gate-to-source voltage $V_{GS}$ of transistor $M_5$ develops across resistor $R_4$, causing current to flow through resistor $R_4$. The transistor load including transistor $M_6$ and transistor $M_7$ mirror that current and cause the mirrored current to flow back into transistor $M_5$, resulting in positive feedback. To ensure a stable operating point, transistor $M_8$ provides negative feedback from the drain of transistor $M_5$ to the gate of transistor $M_5$. The topology of FIG. 2 is exemplary only, and other $V_{GS}$/R voltage reference topologies may provide circuits having lower headroom constraints, but higher noise.

Still referring to FIG. 2, voltage reference generator 200 forces the voltage across resistor $R_4$, which has substantially no temperature coefficient to be equal or approximately equal to the zero temperature coefficient gate-to-source voltage $V_{GS}$ of transistor $M_5$. Although this circuit has lower thermal noise as compared to the circuit of FIG. 1, voltage reference generator 200 is sensitive to process variations since the reference voltage may be affected by the threshold voltage, resistance, mobility, oxide capacitance, and dimensions of transistor $M_5$. In general, the threshold voltage of a metal-oxide-semiconductor field effect transistor (MOSFET) is particularly sensitive to process variations. Process variations may be addressed by trimming resistors $R_2$ and $R_3$ to adjust the ratio of $R_2/R_3$ to gain up gate voltage $V_g$ or by using a programmable width transistor $M_5$, varying the $M_6/M_7$ transistor ratio, or varying the resistance of resistor $R_1$ or combination thereof.

Similarly, thermal variations may be addressed by trimming transistor $M_5$ or trimming transistor $M_6$ and transistor $M_7$ to adjust the transistor ratio $M_6/M_7$, or by trimming resistor $R_1$. In addition, since gate-to-source voltage $V_{GS}\approx 0.5V$ in a typical semiconductor manufacturing technology and the reference voltage is sensitive to loading at node 205, buffer circuit 203 may be required to generate a greater reference voltage level or to reduce sensitivity to load 108. Thus, operational amplifier 206 is coupled in series with node 205. Once the overdrive voltage is set to cancel the temperature coefficient of the threshold voltage variation, resistors $R_2$ and $R_3$ may be adjusted to provide sufficient gain to achieve a constant, target reference voltage (e.g., $V_{out}$). Buffer circuit 203 uses less voltage gain (e.g., 2×gain) than that provided by operational amplifier 104 of voltage reference circuit 100 of FIG. 1 (e.g., 10×gain). Accordingly, buffer circuit 203 contributes less noise than operational amplifier 104.

The two-stage topology of voltage reference generators 100 and 200 of FIGS. 1 and 2 allows for core circuit 101 and core circuit 201, respectively, to be designed independently from the loading conditions. Although the two-stage topology reduces design complexity, it increases noise contributions to the buffered reference signal and may result in a substantial impact on performance. Thus, operational amplifier 206 may be designed to achieve a target noise level, but as a result, consumes more power and area than desirable.

Figure 3:
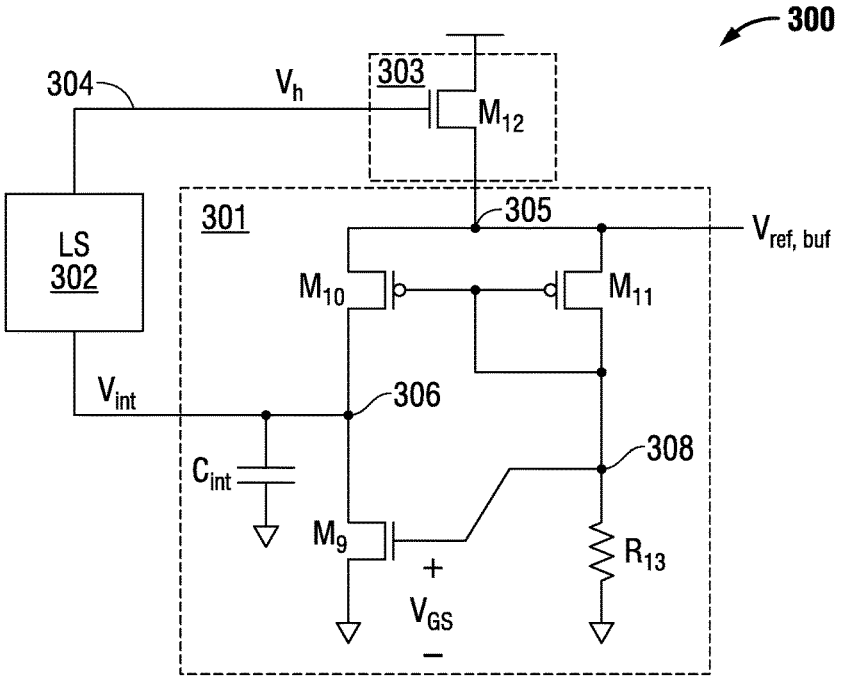
FIG. 3 illustrates a circuit diagram of an exemplary low noise voltage reference generator circuit and load regulator consistent with at least one embodiment of the invention.

Referring to FIG. 3, the topology of voltage reference generator and load regulator 300 has a low output impedance and generates a low noise voltage reference signal with increased power supply rejection (PSR), lower power consumption, and less area than the voltage reference generators 100 and 200 of FIGS. 1 and 2. Referring back to FIG. 3, voltage reference generator and load regulator 300 embeds load regulation within the voltage reference generator circuit. Although some embodiments of the voltage reference generator and load regulator include an operational transconductance amplifier in level-shifting circuit 302, noise from the core circuit 301 dominates the noise performance, which may substantially reduce overall power consumption for a given on-chip regulated supply (e.g., at least by a factor of four) with a negligible impact on noise performance as compared to the topologies of voltage reference generators 100 and 200 of FIGS. 1 and 2. In addition, internal self-regulation provided by level-shifting circuit 302 of FIG. 3 improves the power supply rejection of voltage reference generator 300 over the topologies of FIGS. 1 and 2.

Referring to FIGS. 1, 2, and 3, voltage reference generator and load regulator 300 includes core circuit 301 having a $V_{GS}/R$ topology that is indirectly coupled to a power supply node via buffer circuit 303. Voltage reference generator and load regulator 300 includes level-shifting circuit 302 that shifts a voltage level on an internal, high gain node, rather than amplifying a voltage on a high-impedance node as in voltage reference generator 200. Voltage reference generator and load regulator 300 regulates output reference node 305 to be a low impedance node that may drive a load without sourcing current from core circuit 301, and thus without substantially affecting operation of core circuit 301. Level shifting circuit 302 shifts voltage $V_{int}$ on node 306, a high-gain node of core circuit 301, to generate output reference voltage $V_{ref,buf}$, which supplies core circuit 301. Voltage reference generator and load regulator 300 sources current from buffer circuit 303 instead of from core circuit 301 and utilizes the gain of core circuit 301 at node 306 to feedback a level-shifted version of the signal to an input of buffer circuit 303.

Buffer circuit 303 regulates the power supply voltage and supplies current to a load while only causing small changes in the voltage on node 306. Voltage variation at node 306 is level-shifted and used to control buffer circuit 303 to increase its output current to drive the load while rejecting power supply variation. Unlike core circuit 101 and core circuit 201, core circuit 301 is not directly coupled to the external power supply node. Instead, buffer circuit 303 protects core circuit 301 from external supply surges. By eliminating buffer circuit 103 and buffer circuit 203 and the associated voltage multiplication in series with the core circuit 101 and core circuit 201, respectively, to generate output reference voltage $V_{ref,buf}$, voltage reference generator and load regulator 300 has improved noise performance as compared to voltage reference generator of 100 and voltage reference generator of 200.

When output reference voltage $V_{ref,buf}$ increases, voltage $V_{int}$ decreases, providing negative feedback and decreases voltage $V_h$. Transistor M11 decreases output reference voltage $V_{ref,buf}$ to stabilize the voltage on the output node. Variations in output reference voltage $V_{ref,buf}$ appear across $R_{13}$ and are sensed by transistor $M_9$, which amplifies those variations and feeds back to the input terminal of buffer circuit 303. The voltage change from $V_{int}$ to $V_h$ configures buffer circuit 303 as a voltage source. The feedback provided by buffer circuit 303 reduces the equivalent impedance at node 305. In at least one embodiment, level-shifting circuit 302 increases voltage $V_{int}$ by approximately the gate-to-source voltage $V_{GS}$ of transistor $M_{12}$ (e.g., 0.5V) and an additional amount, to provide headroom for transistor $M_{10}$ (e.g., 100-200 mV) for an exemplary voltage level shift of at least 0.6-0.7 V to ensure that node 306 provides a high impedance point and adequate gain. The current mirror formed by transistors $M_{10}$ and $M_{11}$ provides some gain, but the gain of transistor $M_9$ exceeds the positive feedback provided by gain of the current mirror, thus the negative feedback dominates and provides gain from the output node 305 to node 306.

Still referring to FIG. 3, if process variations cause the threshold voltage of $M_{11}$ to decrease, those process variations typically cause the threshold voltage of $M_9$ to increase. Use of the overdrive voltages of $M_9$ and $M_{12}$ provides positive temperature dependence and device ratios may be altered to obtain target temperature performance. In applications where an inverter circuit is coupled to node 305, the current consumed by the inverter circuit at different process corners would track current consumption of core circuit 301. Various circuit parameters may be varied to alter the temperature response or output reference voltage of circuit 300. For example, resistor $R_{13}$ may have a variable resistance. In at least one embodiment, the gate of transistor $M_{11}$ is coupled to a selectable tap of resistor $R_{13}$ to modify the temperature coefficient to blend gate-to-source voltage $V_{GS}$ of transistor $M_{12}$ and gate-to-source voltage $V_{GS}$ of transistor $M_9$ that level shifts to increase the voltage or decrease the voltage. In addition, the current mirror ratio or the width or length of transistor $M_9$ may be varied, or a combination thereof.

Voltage reference generator and load regulator 300 uses the internal gain of core circuit 301 having a $V_{GS}/R$ circuit topology to gain a signal on an internal node rather than buffering an output of a core circuit of the voltage reference generator in series with the output reference node. In addition, rather than coupling the core circuit directly to the external supply, voltage reference generator and load regulator 300 sources current from a buffer circuit coupled to the external supply. Accordingly, voltage reference generator and load regulator 300 has the ability to deliver load current without substantially affecting core circuit 301.

Figure 4:
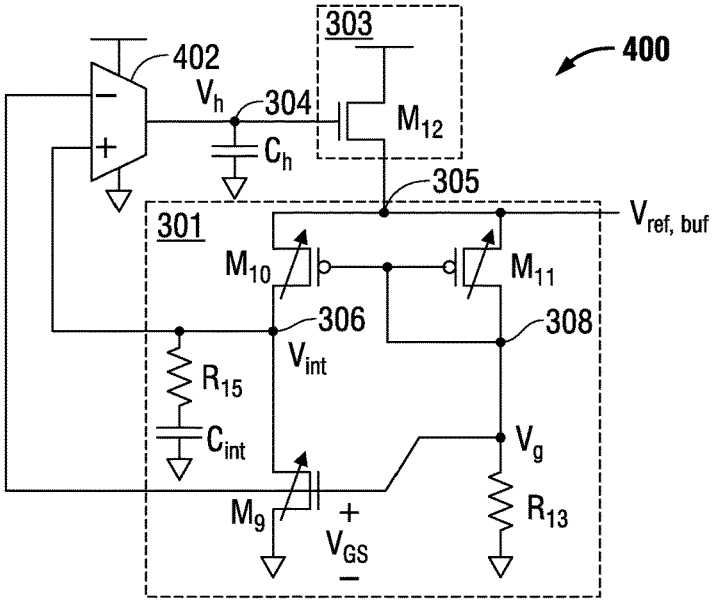
FIG. 4 illustrates a circuit diagram of an exemplary low noise voltage reference generator circuit and load regulator including an active level shifting circuit consistent with at least one embodiment of the invention.
Figure 5:
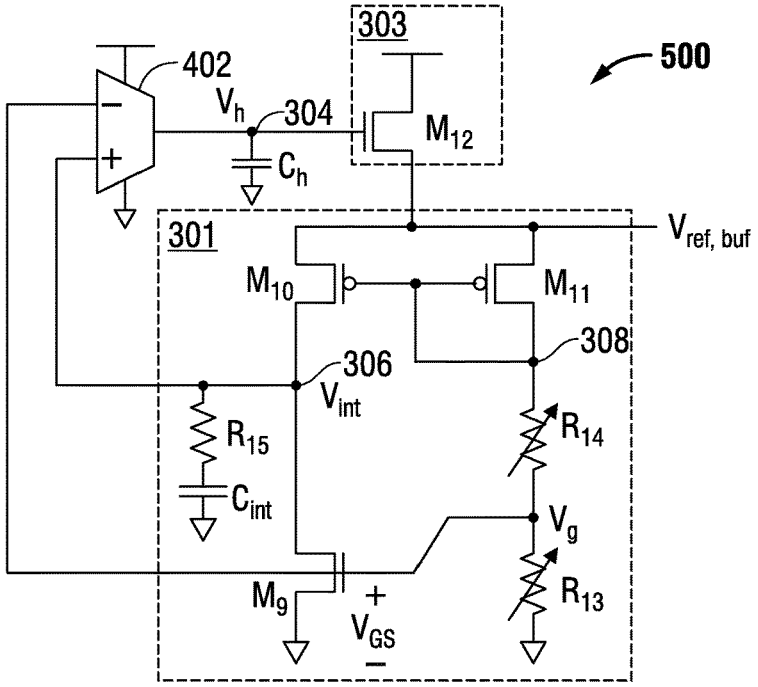
FIG. 5 illustrates a circuit diagram of an exemplary low noise voltage reference generator circuit and load regulator including an active level shifting circuit consistent with at least one embodiment of the invention.
Figure 9:
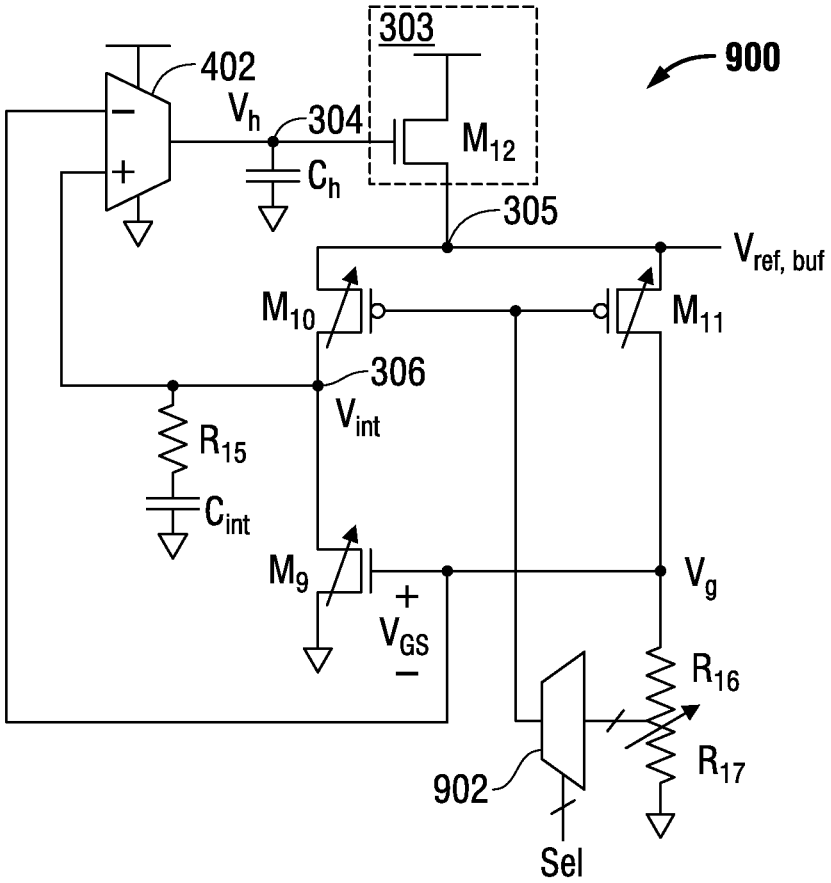
FIG. 9 illustrates a circuit diagram of an exemplary low noise voltage reference generator circuit and load regulator including an active level shifting circuit having selectable device parameters consistent with at least one embodiment of the invention.

Referring to FIGS. 4 and 5, in some embodiments, the voltage reference generator and load regulator includes an active level-shifting circuit. For example, voltage reference generator and load regulators 400 and 500 each include operational transconductance amplifier 402 as the level shifting circuit. Operational transconductance amplifier 402 is configured to provide a level-shifted voltage $V_h$ that controls buffer circuit 303 to force a voltage difference between voltage $V_{int}$ and voltage $V_g$ to zero. In an exemplary low supply voltage application, operational transconductance amplifier 402 receives a power supply voltage from an on-chip charge pump supply, which may be different from the source of the power supply voltage received by buffer circuit 303. By coupling operational transconductance amplifier 402 with the high gain node in a feedback path to the buffer circuit, any operational transconductance amplifier noise is within the feedback loop and is suppressed by the intrinsic gain of core circuit 301. The core reference may be designed for a particular temperature coefficient or target output voltage level or may be trimmed after manufacture for a particular temperature coefficient (e.g., using non-volatile memory or input from a user interface to select the value) for a particular temperature coefficient or output voltage. Referring to FIG. 5, in at least one embodiment voltage reference generator 500 includes variable resistors $R_{13}$ and $R_{14}$ that may be selectively configured to have particular resistances for such adjustments. Referring to FIG. 9, in at least one embodiment, voltage reference generator 900 includes resistors $R_{16}$ and $R_{17}$ having a selectable tap-off point controlled by select circuit 902 to achieve a particular resistance for such adjustments. In addition, one or more of transistors $M_{10}$ and $M_{11}$ may have selectable W/L.

Figure 6:
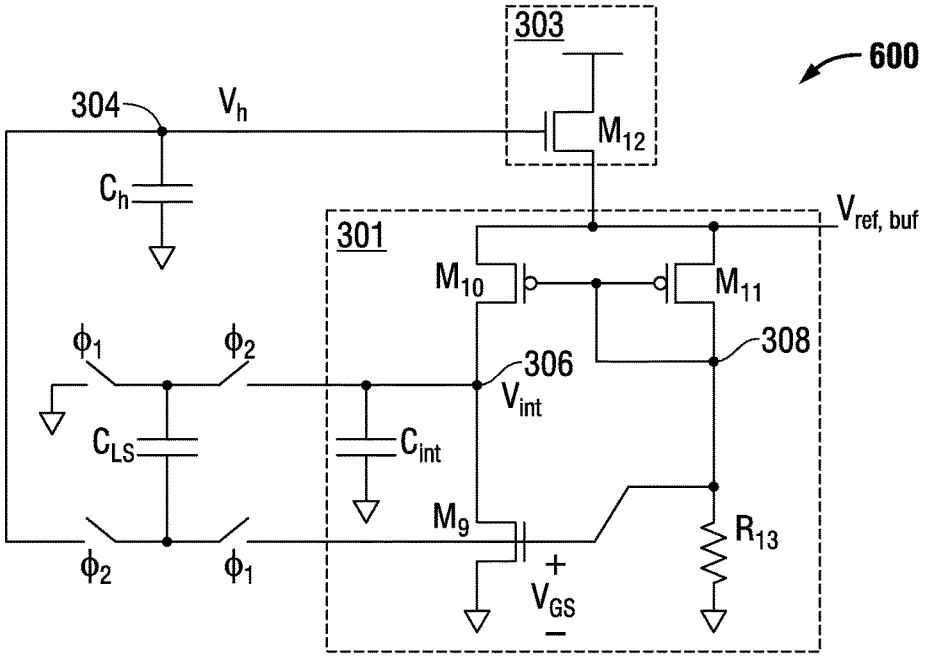
FIG. 6 illustrates a circuit diagram of an exemplary low noise voltage reference generator circuit and load regulator including a passive level shifting circuit consistent with at least one embodiment of the invention.

Referring back to FIG. 3, in some embodiments, level-shifting circuit 302 includes a passive level-shifting circuit to generate the level-shifted voltage $V_h$. Referring to FIG. 6, voltage reference generator and load regulator 600 includes a switched capacitor circuit controlled by first and second clock phases $\phi_1$ and $\phi_2$, which signal alternating time intervals, that are used to store charge on capacitor $C_{LS}$ during a first time interval and to provide that stored charge to integrating capacitor $C_h$ during a second time interval to generate level-shifted voltage $V_h$. Voltage reference generator 600 forces the gate-to-source voltage drop of transistor $M_9$ to be the difference between level-shifted voltage $V_h$ and voltage $V_{int}$. Such embodiments may have little voltage headroom, but may operate sufficiently if $V_{GS}$ of $M_9$ is greater than the combined voltage of the gate-to-source voltage of transistor $M_{12}$ and the overdrive voltage of transistor $M_{10}$.

Figure 7:
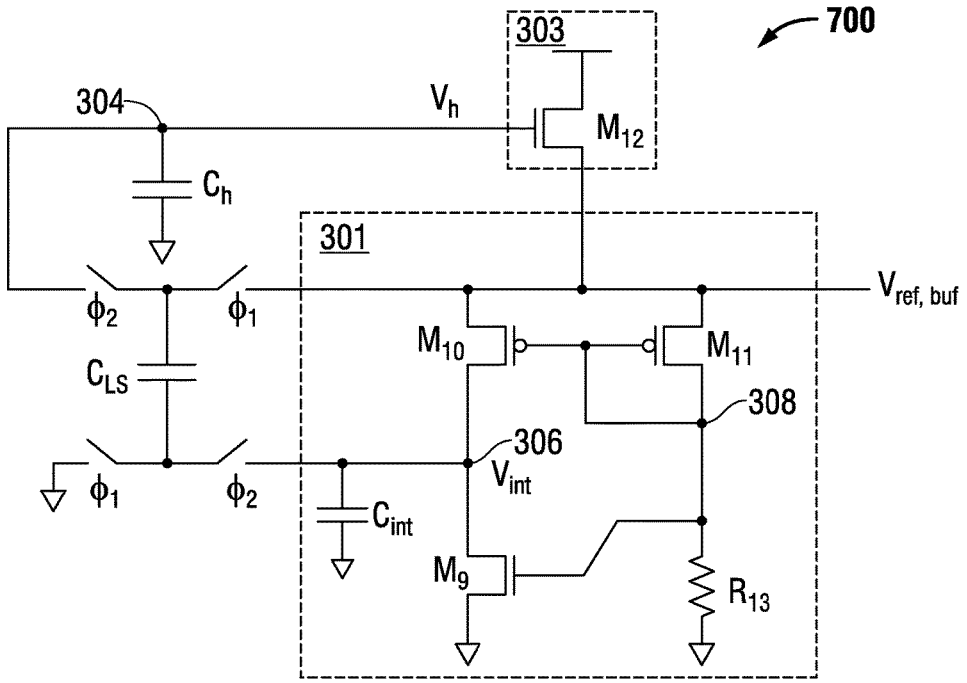
FIG. 7 illustrates a circuit diagram of an exemplary low noise voltage reference generator circuit and load regulator including a passive level shifting circuit with additional voltage headroom consistent with at least one embodiment of the invention.

Referring to FIG. 7, in another embodiment of a voltage reference generator and load regulator including passive level shifting, first and second clock phases $\phi_1$ and $\phi_2$ control a switched capacitor circuit using alternating time intervals to generate level-shifted voltage $V_h$. Capacitor $C_{LS}$ is configured to store charge during a first time interval and is configured to provide that stored charge to integrating capacitor $C_h$ during a second time interval to control buffer circuit 303, which forces output voltage level $V_{ref,buf}$ to be the difference between level-shifted voltage $V_h$ and voltage $V_{int}$. If transistors $M_9$ and $M_{12}$ have similar current densities and the same overdrive voltage, core circuit 301 will have enough gain to supply current to a load without affecting the operation of core circuit 301 and the output voltage level $V_{ref,buf}$.

Figure 8:
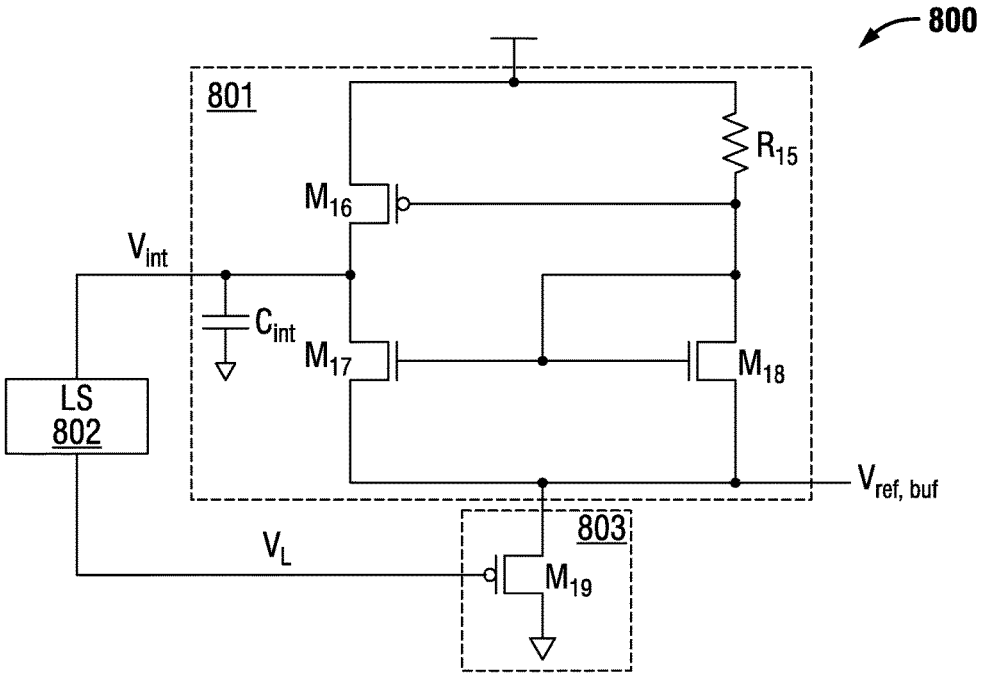
FIG. 8 illustrates an exemplary complementary version of low noise voltage reference generator circuit and load regulator of FIG. 3 consistent with at least one embodiment of the invention.

Referring to FIGS. 3-7, in other embodiments of voltage reference generator and load regulators 300, 400, 500, 600, and 700, the current mirror including transistors $M_{10}$ and $M_{11}$ may be a cascode current mirror including additional transistors configured to be in a saturation region of operation and coupled to transistors $M_{10}$ and $M_{11}$. In other embodiments, complementary versions of voltage reference generator and load regulators 300, 400, 500, 600, and 700 may be used. For example, n-type transistors are replaced with p-type transistors and p-type transistors are replaced with n-type transistors, as illustrated in FIG. 8. Voltage reference generator and load regulator 800 includes buffer circuit 803, which may include a common source p-type device buffer, coupled between an n-type current mirror and a ground reference node. The n-type current mirror formed by transistors $M_{17}$ and $M_{18}$ is configured to develop gate-to-source voltage $V_{GS}$ across resistor $R_{15}$, which is coupled to a power supply node (e.g., VDD). Level-shifting circuit 802 is configured to drive the buffer circuit 803 based on a voltage developed on a node coupled to the drains of transistors $M_{16}$ and $M_{17}$.

Thus, embodiments of a voltage reference generator and load regulator that utilizes internal gain and feedback to generate a low-noise output with reduced sensitivity to power supply variations and loading have been described. While circuits and physical structures have been generally presumed in describing embodiments of the invention, it is well recognized that in modern semiconductor design and fabrication, physical structures and circuits may be embodied in computer-readable descriptive form suitable for use in subsequent design, simulation, test or fabrication stages. Structures and functionality presented as discrete components in the exemplary configurations may be implemented as a combined structure or component. Various embodiments of the invention are contemplated to include circuits, systems of circuits, related methods, and tangible computer-readable medium having encodings thereon (e.g., VHSIC Hardware Description Language (VHDL), Verilog, GDSII data, Electronic Design Interchange Format (EDIF), and/or Gerber file) of such circuits, systems, and methods, all as described herein, and as defined in the appended claims. In addition, the computer-readable media may store instructions as well as data that can be used to implement the invention. The instructions/data may be related to hardware, software, firmware or combinations thereof.

The description of the invention set forth herein is illustrative, and is not intended to limit the scope of the invention as set forth in the following claims. Variations and modifications of the embodiments disclosed herein, may be made based on the description set forth herein, without departing from the scope and spirit of the invention as set forth in the following claims.

What is claimed is:

1. A method comprising:

generating a current based on a voltage drop across a resistor, the voltage drop being equal to a gate-to-source voltage across a gate terminal of a transistor and a source terminal of the transistor;

mirroring the current using a reference voltage to generate a mirrored current through a node coupled to a drain terminal of the transistor;

level-shifting a voltage on the node to generate a level-shifted voltage; and buffering the level-shifted voltage using a power supply voltage to generate the reference voltage.

2. The method, as recited in claim 1, wherein the level-shifting comprises:

passively level-shifting the voltage using a switched capacitor circuit to generate the level-shifted voltage.

3. The method, as recited in claim 2, wherein passively level-shifting the voltage comprises:

during a first time interval of alternating time intervals, storing charge on a first capacitor using a voltage on the gate terminal of the transistor; and during a second time interval of the alternating time intervals, forcing the voltage drop across the gate terminal and the source terminal to be a difference between the level-shifted voltage and a voltage on the drain terminal.

4. The method, as recited in claim 2, wherein passively level-shifting the voltage comprises:

during a first time interval of alternating time intervals, storing charge on a first capacitor of the switched capacitor circuit using the reference voltage; and during a second time interval of the alternating time intervals, forcing the reference voltage to be a difference between the level-shifted voltage and a voltage on the drain terminal.

5. The method, as recited in claim 1, wherein the level-shifting comprises:

adjusting the level-shifted voltage to force a voltage difference between a voltage on the drain terminal of the transistor and a voltage on the gate terminal of the transistor to zero.

6. The method, as recited in claim 1, wherein the level-shifting comprises:

integrating the voltage to generate an integrated voltage; and generating the level-shifted voltage by integrating a difference voltage generated based on the integrated voltage and a voltage on the gate terminal of the transistor.

7. The method, as recited in claim 6, wherein the level-shifting further comprises:

generating the difference voltage based on the integrated voltage and a voltage on the drain terminal of the transistor.

8. The method, as recited in claim 1, wherein the level-shifted voltage provides negative feedback used by the buffering, the negative feedback dominating positive feedback provided by the mirroring.

9. An apparatus comprising:

a buffer circuit configured to transfer a signal from an input node to an output reference node using a power supply voltage on a first power supply node;

a current mirror coupled to the output reference node and configured to generate a mirrored current through a first node based on a first current through a second node and a voltage on the output reference node;

a resistor coupled between the second node and a second power supply node;

a first transistor of a first type coupled between the first node, the second node, and the second power supply node, the first transistor having a gate terminal coupled to the second node, a drain terminal coupled to the first node, and a source terminal coupled to the second power supply node, the first transistor being configured to develop a voltage drop across terminals of the resistor to generate the first current, the voltage drop being equal to a gate-to-source voltage across the gate terminal and the source terminal; and a level-shifting circuit configured to level shift a voltage on the first node to drive the input node of the buffer circuit.

10. The apparatus, as recited in claim 9, wherein the buffer circuit comprises a second transistor of the first type coupled to the first power supply node and the output reference node.

11. The apparatus, as recited in claim 9, wherein the level-shifting circuit includes an active circuit.

12. The apparatus, as recited in claim 10, wherein the level-shifting circuit includes an operational transconductance amplifier configured to adjust a voltage on a gate terminal of the second transistor to force a voltage difference between a voltage on the second node and a voltage on the first node to be zero.

13. The apparatus, as recited in claim 9, wherein the level-shifting circuit is a passive circuit.

14. The apparatus, as recited in claim 9, wherein the level-shifting circuit comprises a switched-capacitor level shifter circuit.

15. The apparatus, as recited in claim 14, wherein the switched-capacitor level shifter circuit comprises:

a first capacitor configured to store charge and level shift a voltage on the gate terminal of the first transistor during a first time interval of alternating time intervals; and a second capacitor configured to receive charge from the first capacitor and provide a level-shifted voltage to the buffer circuit during a second time interval of the alternating time intervals.

16. The apparatus, as recited in claim 15, wherein the first capacitor is coupled across the first node and the second node and the switched-capacitor level shifter circuit is configured to force the voltage drop to be a difference between the level-shifted voltage and a voltage on the first node.

17. The apparatus, as recited in claim 15, wherein the first capacitor is coupled between the output reference node and a third node and the switched-capacitor level shifter circuit is configured to force a voltage on the output reference node to be a difference between the level-shifted voltage and a voltage on the third node.

18. The apparatus, as recited in claim 9, wherein the current mirror comprises:

a second transistor of a second type coupled to the first node, the second node, and the output reference node; and a third transistor of the second type coupled to the second node and the output reference node.

19. The apparatus, as recited in claim 9, further comprising a second resistor configured to develop the gate-to-source voltage of the first transistor across terminals of the second resistor.

20. An apparatus comprising:

means for generating a current flowing between an output reference node and a first power supply node based on a voltage drop across a resistor, the voltage drop being equal to a gate-to-source voltage across a gate terminal of a transistor and a source terminal of the transistor;

means for mirroring the current to generate a mirrored current flowing between the output reference node and a drain terminal of the transistor;

means for level-shifting a voltage on the drain terminal of the transistor to generate a level-shifted voltage; and means for buffering the level-shifted voltage using a voltage on a second power supply node to generate a reference voltage on the output reference node.

21. The apparatus, as recited in claim 9, wherein the gate terminal is directly coupled to the second node, the drain terminal is directly coupled to the first node, and the source terminal is directly coupled to the second power supply node.

* * * * *